US006464805B2

(12) United States Patent
Matsuda et al.

(10) Patent No.: US 6,464,805 B2
(45) Date of Patent: Oct. 15, 2002

(54) ALUMINUM ALLOY PLATE EXCELLING IN FILIFORM CORROSION RESISTANCE AND METHOD OF FABRICATING SAME

(75) Inventors: Shinji Matsuda, Fujisawa (JP); Tsutomu Hattori, Isehara (JP); Masahito Katsukura, Fujisawa (JP); Tadashi Minoda, Nagoya (JP); Hideo Yoshida, Nagoya (JP); Shinichi Matsuda, Nagoya (JP); Mineo Asano, Toyoake (JP); Tsutomu Furuyama, Nagoya (JP)

(73) Assignees: Nissan Motor Co., Ltd., Yokohama (JP); Sumitomo Light Metal Industries, Ltd., Tokyo (JP)

( * ) Notice: Subject to any disclaimer, the term of this patent is extended or adjusted under 35 U.S.C. 154(b) by 24 days.

(21) Appl. No.: 09/817,765

(22) Filed: Mar. 26, 2001

(65) Prior Publication Data

US 2002/0005232 A1 Jan. 17, 2002

(30) Foreign Application Priority Data

Apr. 13, 2000 (JP) ..... 2000-111665

(51) Int. Cl.[7] ..... C22C 21/08
(52) U.S. Cl. ..... 148/417; 420/534; 420/531
(58) Field of Search ..... 148/417; 420/534, 420/535

(56) References Cited

U.S. PATENT DOCUMENTS 4,589,932 A * 5/1986 Park ..... 148/417

OTHER PUBLICATIONS

"ASM Handbook vol. 9: Metallography and Microstructures", ASM International, 1995, pp 356–359.*

* cited by examiner

*Primary Examiner*—George Wyszomierski
*Assistant Examiner*—Janelle Combs-Morillo
(74) *Attorney, Agent, or Firm*—Flynn, Thiel, Boutell & Tanis, P.C.

(57) ABSTRACT

An Al—Mg—Si—Cu aluminum alloy plate excelling in strength and formability and exhibiting improved filiform corrosion resistance which is suitably used for automotive body panels. The aluminum alloy plate contains 0.25–0.6% of Mg (mass %, hereinafter the same), 0.9–1.1% of Si, 0.6–1.0% of Cu, and at least one of 0.20% or less of Mn and 0.10% or less of Cr, with the balance consisting of Al and impurities, wherein the number of Q phases (Cu—Mg—Si—Al phases) with a size of 2 $\mu$m or more in diameter present in a matrix is 150 per $mm^2$ or more. The aluminum alloy plate is fabricated by homogenizing an ingot of an aluminum alloy having the above composition at 530° C. or more, cooling the ingot to 450° C. or less at a cooling rate of 30° C./hour or less, hot-rolling the ingot, cold-rolling the hot-rolled product, and providing the cold-rolled product with a solution heat treatment.

1 Claim, No Drawings

ALUMINUM ALLOY PLATE EXCELLING IN FILIFORM CORROSION RESISTANCE AND METHOD OF FABRICATING SAME

BACKGROUND OF THE INVENTION

1. Field of the Invention

The present invention relates to an aluminum alloy plate excelling in filiform corrosion resistance. More particularly, the present invention relates to a bake-hardenable Al—Mg—Si—Cu aluminum alloy plate, excelling in filiform corrosion resistance, which is suitably used as a material for transportation devices such as an automotive outer body panel, and to a method of fabricating the same.

2. Description of Background Art

In recent years, reduction of the weight of automobiles has been demanded in order to improve fuel consumption from the viewpoint of environmental protection, etc. To deal with this demand, an aluminum alloy plate has been partly used for an automotive outer body panel, in place of a cold-rolled steel plate has conventionally been used.

As examples of aluminum alloys currently used for an automotive outer body panel in practice, Al—Mg alloys such as A5022, A5023, and A5182, and Al—Mg—Si alloys such as A6111, A6016, and A6022 can be given. Al—Mg alloys excel in formability. However, Al—Mg alloys do not exhibit bake-hardenability, thereby exhibiting inferior dent resistance.

Since Al—Mg—Si alloys exhibit excellent bake-hardenability, Al—Mg—Si alloys exhibits superior dent resistance. However, formability of Al—Mg—Si alloys is insufficient. The addition of Cu provides improved formability to Al—Mg—Si alloys due to an increased r value (Lankford value). However, addition of Cu tends to cause intergranular corrosion to occur, thereby resulting in decrease in corrosion resistance, in particular, filiform corrosion resistance. Therefore, the Cu content in the A6016 alloy and the A6022 alloy is limited to 0.20% or less and 0.11% or less, respectively. In addition, A6111 alloys which contain 0.50–0.9% of Cu may exhibit inferior corrosion resistance.

Japanese Patent Application Laid-open No. 10-176233 proposes a method for preventing intergranular corrosion by adding Zn to an Al—Mg—Si alloy containing Cu. The addition of Zn decreases the electric potential of an electrochemical matrix, thereby decreasing the potential difference between $Mg_2Si$ and the matrix. This prevents $Mg_2Si$ precipitated on the grain boundaries from being dissolved under corrosive environment, whereby intergranular corrosion can be prevented. In this method, the Cu content is also limited to 0.8% or less. If the Cu content exceeds 0.8%, corrosion resistance decreases.

Japanese Patent Application Laid-open No. 10-237576 proposes an Al—Mg—Si alloy containing 0.25–1.0% of Cu and exhibiting improved corrosion resistance which is used for an automotive outer body panel, wherein Pb, As, Sn, and other impurity concentrations in a Zn substrate plating layer used for zinc phosphate treatment and paint treatment are limited. However, the object of this technique is to improve corrosion resistance of the material by use of the substrate plating layer for conversion treatment, but not to improve corrosion resistance of the Al—Mg—Si—Cu alloy itself. This method involves difficulty in managing the plating solution.

SUMMARY OF THE INVENTION

The present inventors have conducted extensive experiments and studies to solve the above problems relating to an Al—Mg—Si—Cu alloy used for an automotive outer body panel by improving corrosion resistance of the alloy, and to produce an Al—Mg—Si—Cu alloy exhibiting excellent formability, excellent intergranular corrosion resistance, and improved filiform corrosion resistance after painting. The present inventors have conducted studies from the viewpoint of clarifying the relation between intergranular/filiform corrosion resistance and intermetallic compounds precipitated inside or boundaries of the crystal grains during the fabrication process. Accordingly, an object of the present invention is to provide an Al—Mg—Si—Cu alloy suitable for an automotive outer body panel which excels in strength and formability and exhibits improved filiform corrosion resistance, and a method of fabricating the same.

An aluminum alloy plate excelling in filiform corrosion resistance and a method of fabricating the same according to the present invention are characterized as follows.

(1) An aluminum alloy plate excelling in filiform corrosion resistance, comprising 0.25–0.6% of Mg (mass %, hereinafter the same), 0.9–1.1% of Si, 0.6–1.0% of Cu, and at least one of 0.20% or less of Mn and 0.10% or less of Cr, with the balance consisting of Al and impurities, wherein the number of Q phases (Cu—Mg—Si—Al phases) with a size of 2 $\mu$m or more in diameter present in a matrix is 150 per $mm^2$ or more.

(2) A method of fabricating an aluminum alloy plate excelling in filiform corrosion resistance, comprising: homogenizing an ingot of an aluminum alloy which comprises 0.25–0.6% of Mg, 0.9–1.1% of Si, 0.6–1.0% of Cu, and at least one of 0.20% or less of Mn and 0.10% or less of Cr, with the balance consisting of Al and impurities, at a temperature of 530° C. or more; cooling the ingot to 450° C. or less at a cooling rate of 30° C./hour or less; hot-rolling the ingot; cold-rolling the hot-rolled product; and providing the cold-rolled product with a solution heat treatment.

(3) A method of fabricating an aluminum alloy plate excelling in filiform corrosion resistance, comprising: homogenizing an ingot of an aluminum alloy which comprises 0.25–0.6% of Mg, 0.9–1.1% of Si, 0.6–1.0% of Cu, and at least one of 0.20% or less of Mn and 0.10% or less of Cr, with the balance consisting of Al and impurities, at a temperature of 530° C. or more; cooling the ingot to room temperature; heating the ingot to 500° C. or more and allowing the ingot to stand for 30 minutes or more; cooling the ingot to 450° C. or less at a cooling rate of 30° C./hour or less; hot-rolling the ingot; cold-rolling the hot-rolled product; and providing the cold-rolled product with a solution heat treatment.

(4) In the method of fabricating an aluminum alloy plate excelling in filiform corrosion resistance described in the above (2) or (3), the solution heat treatment may be carried out at 550° C. or less for 30 seconds or less.

DETAILED DESCRIPTION OF THE INVENTION AND PREFERRED EMBODIMENT

The effects of alloy components of the Al—Mg—Si—Cu alloy plate of the present invention and reasons for the limitations thereof are described below. Mg bonds to Si to form intermetallic compounds ($Mg_2Si$), thereby improving the strength of the alloy. The Mg content is preferably 0.25–0.6%. If the Mg content is less than 0.25%, the effect may be insufficient. If the Mg content exceeds 0.6%, bendability may decrease. The Mg content is still more preferably 0.30–0.55%.

Si forms an intermetallic compound ($Mg_2Si$) in the presence of Mg, thereby improving the strength of the alloy. The Si content is preferably 0.9–1.1%. If the Si content is less than 0.9%, the effect of the strength improvement may be insufficient. If the Si content exceeds 1.1%, bendability may decrease.

Cu improves the strength and formability. The Cu content is preferably 0.6–1.0%. If the Cu content is less than 0.6%, formability may be insufficient. If the Cu content exceeds 1.0%, corrosion resistance may decrease.

Mn and Cr miniaturize the crystal grain. The Mn content and the Cr content are preferably 0.20% or less and 0.10% or less, respectively. If the Mn content and the Cr content respectively exceed the upper limits, elongation may decrease. This results in a decrease in bendability and formability. The Mn content and the Cr content are still more preferably less than 0.10% and 0.07% or less, respectively.

Note that the effects of the present invention are not impaired if elements generally included in an Al—Mg—Si—Cu alloy, such as 0.2% or less of Ti, 0.1% or less of B, 1.0% or less of Fe, 0.5% or less of Zn, and 0.05% or less of Zr, are present in the Al—Mg—Si—Cu alloy.

In a matrix of the alloy plate of the present invention having the above composition, it is important that 150 per $mm^2$ or more of Q phases (Cu—Mg—Si—Al phases) with a size of 2 $\mu$m or more in diameter are present. This precipitation configuration provides preferable corrosion resistance.

Corrosion configuration of the Al—Mg—Si—Cu alloy is mainly intergranular corrosion. Filiform corrosion of the painted plate is considered to be caused by intergranular corrosion of the material below the paint. Therefore, it is necessary to improve intergranular corrosion resistance of the material to prevent filiform corrosion of the painted plate. Intergranular corrosion resistance of the material depends on the configuration of precipitates present on the crystal grain boundaries of the material matrix or precipitate free zones (PFZs).

The Q phases (Cu—Mg—Si—Al phases) are crystallized during casting or precipitated in a step during the fabrication of the alloy plate. The Q phases contain undissolved Cu and are mainly crystallized or precipitated in the crystal grains. When the Q phases are dissolved during high-temperature heat treatment such as a solution heat treatment, the amount of solid-solution of Mg, Si, and Cu increases. This tends to cause $Mg_2Si$ compounds containing Cu to be precipitated on the crystal grain boundaries, whereby the potential difference among the precipitates, PFZs, and inside the grains increases. This decreases intergranular corrosion resistance, whereby filiform corrosion tends to occur in the resulting painted plate.

In the present invention, the number of Q phases (Cu—Mg—Si—Al phases) with a size of 2 $\mu$m or more in diameter is preferably 150 per $mm^2$ or more. If the number is less than 150 per $mm^2$, filiform corrosion tends to occur due to decreased corrosion resistance. The number of Q phases can be determined by Electron Probe Micro Analyzer (EPMA). The number of Q phases is determined by counting the number of spots with a size of 2 $\mu$m or more in diameter where Mg, Si, and Cu are simultaneously present.

The method of fabricating the aluminum alloy plate of the present invention is described below. In the present invention, an aluminum alloy having the above composition is cast by Direct Chill (DC) Casting Process. The resulting ingot is subjected to homogenization, hot-rolling, and cold-rolling to prepare a plate material. The plate material is then provided with a solution heat treatment to obtain a T4 temper material.

Conventionally, it is considered to be preferable for the homogenization temperature of Al—Mg—Si alloys to be as high as possible to promote solid-solution of Mg and Si and cutting/spheroidizing of Al—Fe—Si constituent particles. However, high-temperature homogenization causes dissolution of the Q phases crystallized during casting, thereby decreasing filiform corrosion resistance of the resulting painted plate. This requires precipitating of Q phases after homogenization.

As a result of various tests and examinations, the present inventors have confirmed that the Q phases are reprecipitated by cooling the homogenized ingot at a rate as slow as possible. The present inventors have conducted further examinations and found the optimum homogenization conditions. Specifically, the homogenization temperature is preferably 530° C. or more. If the homogenization temperature is less than 530° C., the amount of solid-solution of Mg and Si decreases, whereby the strength may become insufficient. Moreover, bake-hardenability decreases. The homogenization temperature is still more preferably 560° C. or more.

In the case of hot-rolling the ingot immediately after homogenization, the homogenized ingot is cooled to 450° C. or less at a cooling rate of 30° C./hour or less, thereby causing the Q phases to be reprecipitated during cooling. Hot-rolling is started at this temperature. If the cooling rate exceeds 30° C./hour or the hot-rolling starting temperature exceeds 450° C., precipitation of the Q phases becomes insufficient whereby filiform corrosion resistance decreases. The hot-rolling starting temperature is still more preferably 420° C. or less. In this case, the homogenized ingot is cooled to 420° C. or less at a cooling rate of 30° C./hour or less. Hot-rolling is started at this temperature.

In the case of cooling the homogenized ingot to room temperature and heating the ingot before hot-rolling, the homogenized ingot is cooled to room temperature. The ingot is then heated to 500° C. or more and allowed to stand for 30 minutes or more. The ingot is then cooled to 450° C. or less at a cooling rate of 30° C./hour or less. Hot-rolling is started at this temperature. If the cooling rate exceeds 30° C./hour or the hot-rolling starting temperature exceeds 450° C., precipitation of the Q phases becomes insufficient, whereby filiform corrosion resistance decreases. The hot-rolling starting temperature is still more preferably 420° C. or less. In this case, the ingot is heated to 500° C. or more and cooled to 420° C. or less at a cooling rate of 30° C./hour or less. Hot-rolling is started at this temperature.

After hot-rolling, the hot-rolled product is optionally provided with intermediate annealing and then cold-rolled to obtain a plate material with a predetermined thickness. The plate material is then provided with solution heat treatment to obtain a T4 temper material. It is preferable to perform solution heat treatment at a low temperature for a short period of time to prevent decomposition of the Q phases. In an equilibrium state, a dissolution reaction shown by "Al+Q phase→Liq.+$Mg_2Si$+Si" occurs at 529° C. In a solution heat treatment by rapid heating, the Q phases are not completely dissolved at 550° C. or less. Therefore, it is preferable to perform the solution treatment at 550° C. or less. The solution treatment temperature is still more preferably less than 529° C. The solution treatment is preferably performed for 30 seconds or less, and still more preferably for 10 seconds or less. Solution treatment by rapid heating using a continuous annealing line (CAL) is suitably employed.

EXAMPLES

The effects of the present invention are described below using examples and comparative examples. These examples illustrate an embodiment of the present invention, which should not be construed as limiting the present invention. Various modifications and variations are possible within the scope of the present invention.

Example 1

Aluminum alloys having a composition shown in Table 1 were cast by Direct Chill (DC) Casting Process according to a conventional method. The resulting ingots were homogenized at 550° C. for six hours. The ingots were cooled to 400° C. at a cooling rate of 25° C./hour and immediately hot-rolled to a thickness of 4.5 mm. The hot-rolled products were provided with intermediate annealing and cold-rolled to fabricate cold-rolled plates with a thickness of 1.0 mm.

The cold-rolled plates thus fabricated were provided with a solution heat treatment in a CAL at 525° C. for five seconds. These plates were rapidly cooled to 80° C. and then gradually cooled to room temperature. The resulting T4 temper materials were allowed to stand at room temperature for seven days. The number of Q phases with a size of 2 $\mu$m or more in diameter was then determined by an EPMA. The materials were also subjected to a tensile test and an Erichsen test. Bendability and filiform corrosion resistance of the materials were evaluated according to the methods described below. The results are shown in Table 2.

Evaluation of Bendability:

5% of prestrain was introduced by uniaxial tensile test equipment. The material was bent at 180° with an inner bend radius of 0.5 mm. Bendability was evaluated by the presence or absence of external cracks.

Evaluation of Filiform Corrosion Resistance:

The material was provided with zinc phosphate treatment using a zinc phosphate solution (pH: 2.5–3.5, F concentration: 500ppm) conventionally used for automotive steel plates. The material was applied by electrodeposition (thickness: 20 $\mu$m) according to a conventional painting process for materials for automotive members. Then, the material was baked at 170° C. for 20 minutes. After baking, the coating was cross-cut and subjected to seven cycles of a corrosion test consisting of 24 hours of salt spraying and 120 hours of a humidity cabinet test. After the test, the maximum filiform corrosion length was measured.

As shown in Table 2, test materials Nos. 1 to 5 according to the present invention exhibited excellent strength and formability, and showed excellent corrosion resistance with a maximum filiform corrosion length of less than 3 mm.

TABLE 1

| Alloy | Composition (mass %) | | | | | | | |
|---|---|---|---|---|---|---|---|---|
| No. | Si | Fe | Cu | Mn | Mg | Cr | Zn | Ti |
| A | 0.98 | 0.14 | 0.78 | 0.05 | 0.44 | 0.02 | 0.03 | 0.02 |
| B | 0.92 | 0.15 | 0.62 | 0.06 | 0.37 | 0.02 | 0.03 | 0.02 |
| C | 0.93 | 0.14 | 0.64 | 0.07 | 0.28 | 0.03 | 0.02 | 0.03 |
| D | 1.08 | 0.12 | 0.92 | 0.08 | 0.53 | 0.03 | 0.02 | 0.03 |
| E | 1.07 | 0.13 | 0.94 | 0.07 | 0.58 | 0.03 | 0.02 | 0.02 |

TABLE 2

| | Yield strength (MPa) | Erichsen value (rum) | Bend-ability | Number of Q phase (/mm$^2$) | Maximum filiform corrosion length (mm) |
|---|---|---|---|---|---|
| 1 | 122 | 10.0 | Good | 233 | 2.1 |
| 2 | 115 | 9.8 | Good | 261 | 1.8 |
| 3 | 112 | 9.8 | Good | 250 | 1.7 |

TABLE 2-continued

| | Yield strength (MPa) | Erichsen value (rum) | Bend-ability | Number of Q phase (/mm$^2$) | Maximum filiform corrosion length (mm) |
|---|---|---|---|---|---|
| 4 | 129 | 10.0 | Good | 312 | 2.3 |
| 5 | 134 | 10.0 | Good | 364 | 2.5 |

(Note on bendability) Good: no cracks Bad: cracks occurred

Example 2

Aluminum alloys having a composition shown in Table 1 were cast by DC casting according to a conventional method. The resulting ingots were homogenized at 550° C. for six hours and cooled to room temperature. The ingots were heated to 540° C. and allowed to stand for one hour. The ingots were then cooled to 400° C. at a cooling rate of 25° C./hour and immediately hot-rolled to a thickness of 4.5 mm. The hot-rolled products were provided with intermediate annealing and cold-rolled to fabricate cold-rolled plates with a thickness of 1.0 mm.

The cold-rolled plates thus fabricated were provided with solution heat treatment in a CAL at 525° C. for five seconds. These plates were rapidly cooled to 80° C. and then gradually cooled to room temperature. The resulting T4 temper materials were allowed to stand at room temperature for seven days. The number of Q phases with a size of 2 $\mu$m or more in diameter was determined by an EPMA in the same manner as in Example 1. The materials were also subjected to a tensile test and an Erichsen test. Bendability and filiform corrosion resistance of the materials were evaluated according to the same methods as in Example 1. The results are shown in Table 3. As shown in Table 3, test materials Nos. 6 to 10 according to the present invention exhibited excellent strength and formability, and showed excellent corrosion resistance with a maximum filiform corrosion length of less than 3 mm.

TABLE 3

| | Yield strength (MPa) | Erichsen value (mm) | Bend-ability | Number of Q phase (/mm$^2$) | Maximum filiform corrosion length (mm) |
|---|---|---|---|---|---|
| 6 | 120 | 10.1 | Good | 292 | 2.0 |
| 7 | 112 | 9.9 | Good | 265 | 1.8 |
| 8 | 113 | 9.8 | Good | 271 | 1.6 |
| 9 | 128 | 10.1 | Good | 310 | 2.4 |
| 10 | 132 | 10.1 | Good | 372 | 2.4 |

Comparative Example 1

Aluminum alloys having a composition shown in Table 4 were cast by DC casting according to a conventional method. The resulting ingots were homogenized at 550° C. for six hours. The ingots were then cooled to 400° C. at a cooling rate of 25° C./hour and immediately hot-rolled to a thickness of 4.5 mm. The hot-rolled products were provided with intermediate annealing and cold-rolled to fabricate cold-rolled plates with a thickness of 1.0 mm.

The cold-rolled plates thus fabricated were provided with solution heat treatment in a CAL at 525° C. for five seconds. These plates were rapidly cooled to 80° C. and then gradually cooled to room temperature. The resulting T4 temper materials were allowed to stand at room temperature for seven days. The number of Q phases with a size of 2 $\mu$m or more in diameter was determined by an EPMA in the same manner as in Example 1. The materials were also subjected to a tensile test and an Erichsen test. Bendability and filiform corrosion resistance of the materials were evaluated according to the same methods as in Example 1. The results are shown in Table 5.

TABLE 4

| Alloy | Composition (mass %) | | | | | | | |
|---|---|---|---|---|---|---|---|---|
| No. | Si | Fe | Cu | Mn | Mg | Cr | Zn | Ti |
| F | 0.76 | 0.14 | 0.81 | 0.06 | 0.42 | 0.03 | 0.03 | 0.02 |
| G | 1.23 | 0.15 | 0.78 | 0.06 | 0.43 | 0.02 | 0.03 | 0.02 |
| H | 0.98 | 0.14 | 0.47 | 0.07 | 0.40 | 0.02 | 0.03 | 0.03 |
| I | 0.96 | 0.13 | 1.12 | 0.06 | 0.42 | 0.03 | 0.02 | 0.03 |
| J | 0.98 | 0.14 | 0.77 | 0.05 | 0.19 | 0.03 | 0.02 | 0.02 |
| K | 0.99 | 0.15 | 0.79 | 0.06 | 0.68 | 0.02 | 0.03 | 0.02 |
| L | 1.01 | 0.15 | 0.49 | 0.26 | 0.41 | 0.13 | 0.03 | 0.03 |

TABLE 5

| | Yield strength (MPa) | Erichsen value (mm) | Bend-ability | Number of Q phase (/mm$^2$) | Maximum filiform corrosion length (mm) |
|---|---|---|---|---|---|
| 11 | 95 | 10.0 | Good | 223 | 1.3 |
| 12 | 138 | 9.9 | Bad | 302 | 2.5 |
| 13 | 107 | 9.2 | Good | 207 | 2.3 |
| 14 | 137 | 10.8 | Good | 436 | 5.2 |
| 15 | 83 | 9.6 | Good | 132 | 3.2 |
| 16 | 126 | 10.1 | Bad | 321 | 2.7 |
| 17 | 134 | 8.7 | Bad | 312 | 2.3 |

As shown in Table 5, test material No. 11 exhibited low yield strength of less than 100 MPa due to low Si content. Cracks occurred in test material No. 12 during the bending test due to high Si content. Test material No. 13 exhibited an inferior Erichsen value due to low Cu content. Test material No. 14 exhibited inferior filiform corrosion resistance due to high Cu content. Test material No. 15 exhibited low yield strength of less than 100 MPa due to low Mg content In addition, test material No. 15 exhibited inferior filiform corrosion resistance due to the small number of Q phases with a size of 2 $\mu$m or more in diameter. Test material No. 16 exhibited inferior bendability due to high Mg content. Test material No. 17 exhibited a low Erichsen value due to high Mn/Cr content, whereby cracks occurred during the bending test.

Comparative Example 2

Aluminum alloys Nos. A to E having a composition shown in Table 1 were cast by DC casting according to a conventional method. The resulting ingots were homogenized at 550° C. for six hours. The ingots were cooled to 400° C. at a cooling rate of 25° C./hour and immediately hot-rolled to a thickness of 4.5 mm. The hot-rolled products were provided with intermediate annealing and cold-rolled to fabricate cold-rolled plates with a thickness of 1.0 mm.

The cold-rolled plates thus fabricated were provided with solution heat treatment in a CAL at 570° C. for 120 seconds. These plates were rapidly cooled to 80° C. and then gradually cooled to room temperature. The resulting T4 temper materials were allowed to stand at room temperature for seven days. The number of Q phases with a size of 2 $\mu$m or more in diameter was determined by an EPMA in the same manner as in Example 1. The materials were also subjected to a tensile test and an Erichsen test. Bendability and filiform corrosion resistance of the materials were evaluated according to the same methods as in Example 1. The results are shown in Table 6.

TABLE 6

| | Yield strength (MPa) | Erichsen value (mm) | Bend-ability | Number of Q phase (/mm$^2$) | Maximum filiform corrosion length (mm) |
|---|---|---|---|---|---|
| 18 | 131 | 9.7 | Good | 0 | 4.8 |
| 19 | 126 | 9.5 | Good | 0 | 4.6 |
| 20 | 120 | 9.6 | Good | 0 | 4.2 |
| 21 | 138 | 9.8 | Good | 0 | 5.2 |
| 22 | 142 | 9.9 | Good | 0 | 5.6 |

As shown in Table 6, a Q phase with a size of 2 $\mu$m or more in diameter was not present in test materials Nos. 18 to 22 due to the high solution treatment temperature. Because of this, test materials Nos. 18 to 22 exhibited inferior filiform corrosion resistance.

Comparative Example 3

Aluminum alloys Nos. A to E having a composition shown in Table 1 were cast by DC casting according to a conventional method. The resulting ingots were homogenized at 550° C. for six hours. The ingots were cooled to 480° C. at a cooling rate of 50° C./hour and immediately hot-rolled to a thickness of 4.5 mm. The hot-rolled products were provided with intermediate annealing and cold-rolled to fabricate cold-rolled plates with a thickness of 1.0 mm.

The cold-rolled plates thus fabricated were provided with solution heat treatment in a CAL at 525° C. for five minutes. These plates were rapidly cooled to 80° C. and then gradually cooled to room temperature. The resulting T4 temper materials were allowed to stand at room temperature for seven days. The number of Q phases with a size of 2 $\mu$m or more in diameter was determined by an EPMA in the same manner as in Example 1. The materials were also subjected to a tensile test and an Erichsen test. Bendability and filiform corrosion resistance of the materials were evaluated according to the same methods as in Example 1. The results are shown in Table 7.

TABLE 7

| | Yield strength (MPa) | Erichsen value (mm) | Bend-ability | Number of Q phase (/mm$^2$) | Maximum filiform corrosion length (mm) |
|---|---|---|---|---|---|
| 23 | 127 | 9.8 | Good | 37 | 4.2 |
| 24 | 124 | 9.7 | Good | 28 | 4.3 |
| 25 | 118 | 9.8 | Good | 23 | 3.9 |
| 26 | 136 | 9.9 | Good | 46 | 4.9 |
| 27 | 140 | 10.1 | Good | 53 | 5.4 |

As shown in Table 7, since the cooling rate of the homogenized ingots exceeded 30° C./hour and hot-rolling was started at a high temperature, precipitation of Q phases with a size of 2 $\mu$m or more in diameter was inadequate in test materials Nos. 23 to 27. Therefore, these test materials exhibited inferior filiform corrosion resistance.

Comparative Example 4

Aluminum alloys Nos. A to E having a composition shown in Table 1 were cast by DC casting according to a conventional method. The resulting ingots were homogenized at 550° C. for six hours and cooled to room temperature. The ingots were heated to 540° C. and allowed to stand at 540° C. for one hour. Then, the ingots were cooled to 480° C. at a cooling rate of 50° C./hour and immediately hot-rolled to a thickness of 4.5 mm. The hot-rolled products were provided with intermediate annealing and cold-rolled to fabricate cold-rolled plates with a thickness of 1.0 mm.

The cold-rolled plates thus fabricated were provided with solution heat treatment in a CAL at 525° C. for five seconds. These plates were rapidly cooled to 80° C. and then gradually cooled to room temperature. The resulting T4 temper materials were allowed to stand at room temperature for seven days. The number of Q phases with a size of 2 μm or more in diameter was determined by an EPMA in the same manner as in Example 1. The materials were also subjected to a tensile test and an Erichsen test. Bendability and filiform corrosion resistance of the materials were evaluated according to the same methods as in Example 1. The results are shown in Table 8.

TABLE 8

| | Yield strength (MPa) | Erichsen value (mm) | Bend-ability | Number of Q phase (/mm$^2$) | Maximum filiform corrosion length (mm) |
|---|---|---|---|---|---|
| 28 | 125 | 9.9 | Good | 57 | 4.0 |
| 29 | 122 | 9.7 | Good | 43 | 4.1 |
| 30 | 117 | 9.8 | Good | 39 | 3.5 |
| 31 | 133 | 9.8 | Good | 59 | 4.3 |
| 32 | 139 | 10.0 | Good | 65 | 5.2 |

As shown in Table 8, since the cooling rate of the homogenized ingots exceeded 30° C./hour and hot-rolling was started at a high temperature, precipitation of Q phases with a size of 2 μm or more in diameter was inadequate in test materials Nos. 28 to 32. Therefore, these test materials exhibited inferior filiform corrosion resistance.

As described above, the present invention provides an Al—Mg—Si—Cu aluminum alloy plate excelling in strength and formability and exhibiting improved filiform corrosion resistance, which is suitably used for automotive outer body panels, and a method of manufacturing the same.

What is claimed is:

1. An aluminum alloy plate excelling in filiform corrosion resistance, comprising 0.25–0.6% of Mg (mass %, hereinafter the same), 0.9–1.1% of Si, 0.6–1.0% of Cu, and at least one of 0.20% or less of Mn and 0.10% or less of Cr, with the balance consisting of Al and impurities, wherein the number of Q phases (Cu—Mg—Si—Al phases) with a size of 2 μm or more in diameter present in a matrix is 150 per mm$^2$ or more.

* * * * *